US010622745B2

(12) United States Patent
Rouillard et al.

(10) Patent No.: US 10,622,745 B2
(45) Date of Patent: Apr. 14, 2020

(54) CONTACT OF AN ELECTRICAL CONNECTOR

(71) Applicants: Tyco Electronics France SAS, Pontoise (FR); Tyco Electronics Belgium EC BVBA, Oostkamp (BE); TE Connectivity India Private Limited, Bangalore (IN)

(72) Inventors: Xavier Rouillard, Franconville la Garenne (FR); Lieven Dossche, Pittem (BE); Vinayakumar Shettar, Badami (IN)

(73) Assignees: Tyco Electronics France SAS, Pontoise (FR); Tyco Electronics Belgium EC BVBA, Oostkamp (BE); TE Connectivity India Private Limited, Bangalore (IN)

( * ) Notice: Subject to any disclaimer, the term of this patent is extended or adjusted under 35 U.S.C. 154(b) by 0 days.

(21) Appl. No.: 16/117,464

(22) Filed: Aug. 30, 2018

(65) Prior Publication Data

US 2019/0074626 A1 Mar. 7, 2019

(30) Foreign Application Priority Data

Sep. 1, 2017 (IN) ..... 201741031018

(51) Int. Cl.
*H01R 13/432* (2006.01)
*H01R 43/16* (2006.01)
*H01R 13/11* (2006.01)

(52) U.S. Cl.
CPC ..... *H01R 13/432* (2013.01); *H01R 13/11* (2013.01); *H01R 43/16* (2013.01); *H01R 13/113* (2013.01); *H01R 13/114* (2013.01)

(58) Field of Classification Search
CPC .. H01R 13/432; H01R 13/055; H01R 13/052; H01R 13/113; H01R 13/111; H01R 13/11
USPC ..... 439/869, 871, 872, 851, 852, 861
See application file for complete search history.

(56) References Cited

U.S. PATENT DOCUMENTS 4,781,628 A * 11/1988 Detter ..... H01R 13/432 439/748
5,443,592 A * 8/1995 Ittah ..... H01R 13/113 439/839
5,540,603 A * 7/1996 Fujiwara ..... H01R 13/11 439/839
5,613,885 A * 3/1997 Plate ..... H01R 13/187 439/843
5,630,738 A * 5/1997 Ito ..... H01R 13/113 439/851
5,735,717 A * 4/1998 Nabeshima ..... H01R 13/11 439/851

(Continued)

FOREIGN PATENT DOCUMENTS

DE 102011080362 A * 2/2013 ..... H01R 13/432

*Primary Examiner* — Tulsidas C Patel
*Assistant Examiner* — Marcus E Harcum
(74) *Attorney, Agent, or Firm* — Barley Snyder

(57) ABSTRACT

A contact for an electrical connector is formed of a single piece of stamped and bent sheet metal. The contact includes a body having a base, a limit stop, and a latching tongue connected to the body at the base and having a free end opposite the base. The latching tongue is spaced apart from the limit stop in a resting position of the latching tongue and the latching tongue abuts the limit stop in a deflected position of the latching tongue.

17 Claims, 4 Drawing Sheets

(56) References Cited

U.S. PATENT DOCUMENTS

| | | | | |
|---|---|---|---|---|
| 5,971,816 | A * | 10/1999 | Chaillot | H01R 13/113 439/852 |
| 5,980,336 | A * | 11/1999 | Hall | H01R 13/113 439/843 |
| 5,997,363 | A * | 12/1999 | Joly | H01R 13/521 439/748 |
| 7,303,447 | B1 * | 12/2007 | Tyler | H01R 9/031 439/746 |
| 2004/0224569 | A1 * | 11/2004 | Katsuma | H01R 13/432 439/748 |
| 2013/0288547 | A1 * | 10/2013 | Amano | H01R 13/113 439/852 |
| 2015/0140876 | A1 * | 5/2015 | Lehner | H01R 13/04 439/891 |
| 2017/0047677 | A1 * | 2/2017 | Bhagyanathan Sathianathan | H01R 13/113 |

* cited by examiner

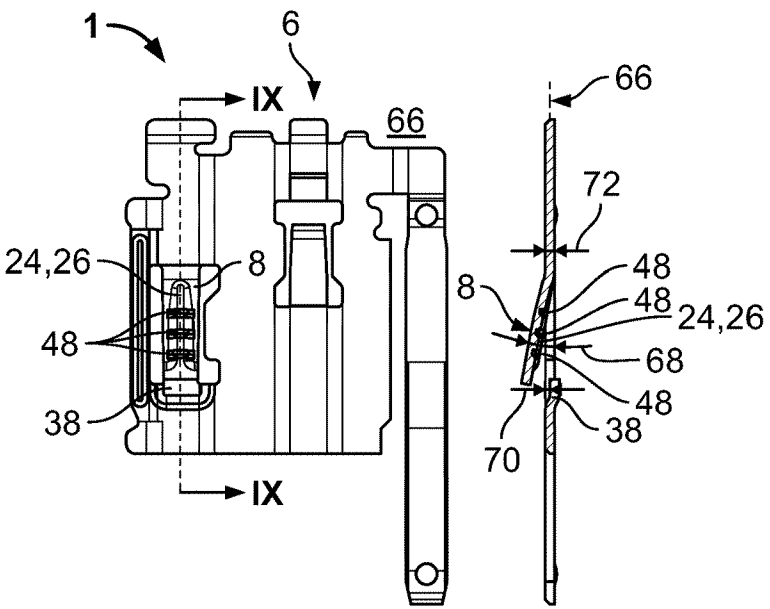
Fig. 9A
IX-IX
Fig. 9B
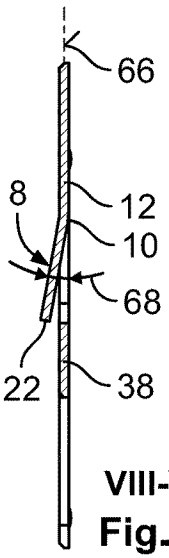
VIII-VIII
Fig. 8B
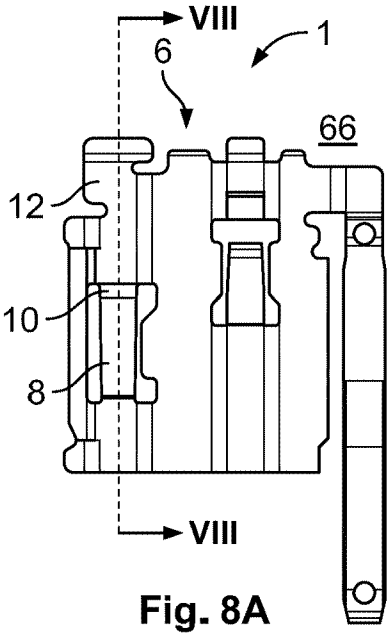
Fig. 8A
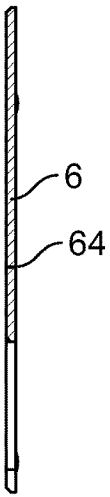
VII-VII
Fig. 7B
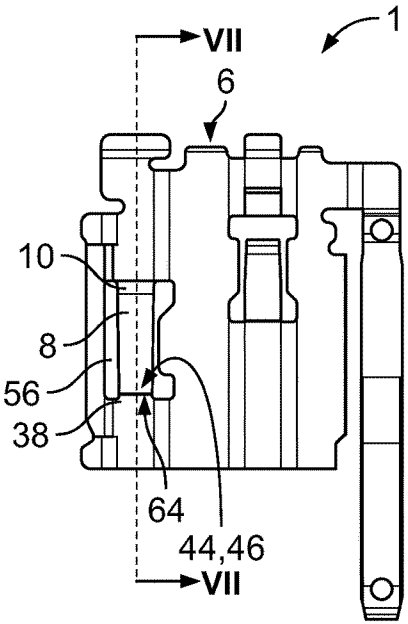
Fig. 7A

CONTACT OF AN ELECTRICAL CONNECTOR

CROSS-REFERENCE TO RELATED APPLICATION

This application claims the benefit of the filing date under 35 U.S.C. § 119(a)-(d) of Indian Patent Application No. 201741031018, filed on Sep. 1, 2017.

FIELD OF THE INVENTION

The present invention relates to a contact of an electrical connector and, more particularly, to a contact of an electrical connector having a latching tongue.

BACKGROUND

A contact of an electrical connector is commonly used to establish an electrical connection between the contact and a mating contact. The contact is inserted into the connector, in particular a housing of the connector, and fixed therein by latching. The contact can be removed for inspection and/or replacement. For securely fastening the contact in the housing, the contact has a latching tongue which engages a complementary mating fastener in the connector. The contact may be male or female and may be made from a single piece of stamped and bent sheet metal. The latching tongue may be cut free, for example, at three sides by stamping or cutting, but stays connected with a body of the contact at a base of the contact. The base forms a hinge about which the latching tongue is elastically deflected to allow the latching operation and to allow the latching tongue to be moved out of the way when the contact is inserted into or removed from the connector.

There is a risk that, during installation or removal of the contact, the contact is deformed. Plastic deformation of the contact may reduce the latching force and/or affect the position of the contact within the housing. This in turn may result in either a loose fixation of the contact within the connector, or in a fixation which is too weak and thus may be released upon connecting or disconnecting the contact and the mating contact.

SUMMARY

A contact for an electrical connector is formed of a single piece of stamped and bent sheet metal. The contact includes a body having a base, a limit stop, and a latching tongue connected to the body at the base and having a free end opposite the base. The latching tongue is spaced apart from the limit stop in a resting position of the latching tongue and the latching tongue abuts the limit stop in a deflected position of the latching tongue.

BRIEF DESCRIPTION OF THE DRAWINGS

The invention will now be described by way of example with reference to the accompanying Figures, of which:

FIG. 7A is a plan view of a sheet metal blank in a first state;

FIG. 7B is a sectional side view of the sheet metal blank taken along line VII-VII of FIG. 7A;

FIG. 8A is a plan view of the sheet metal blank in a second state;

FIG. 8B is a sectional side view of the sheet metal blank taken along line VIII-VIII of FIG. 8A;

FIG. 9A is a plan view of the sheet metal blank in a third state;

FIG. 9B is a sectional side view of the sheet metal blank taken along line IX-IX of FIG. 9A;

DETAILED DESCRIPTION OF THE EMBODIMENT(S)

Figure 1:
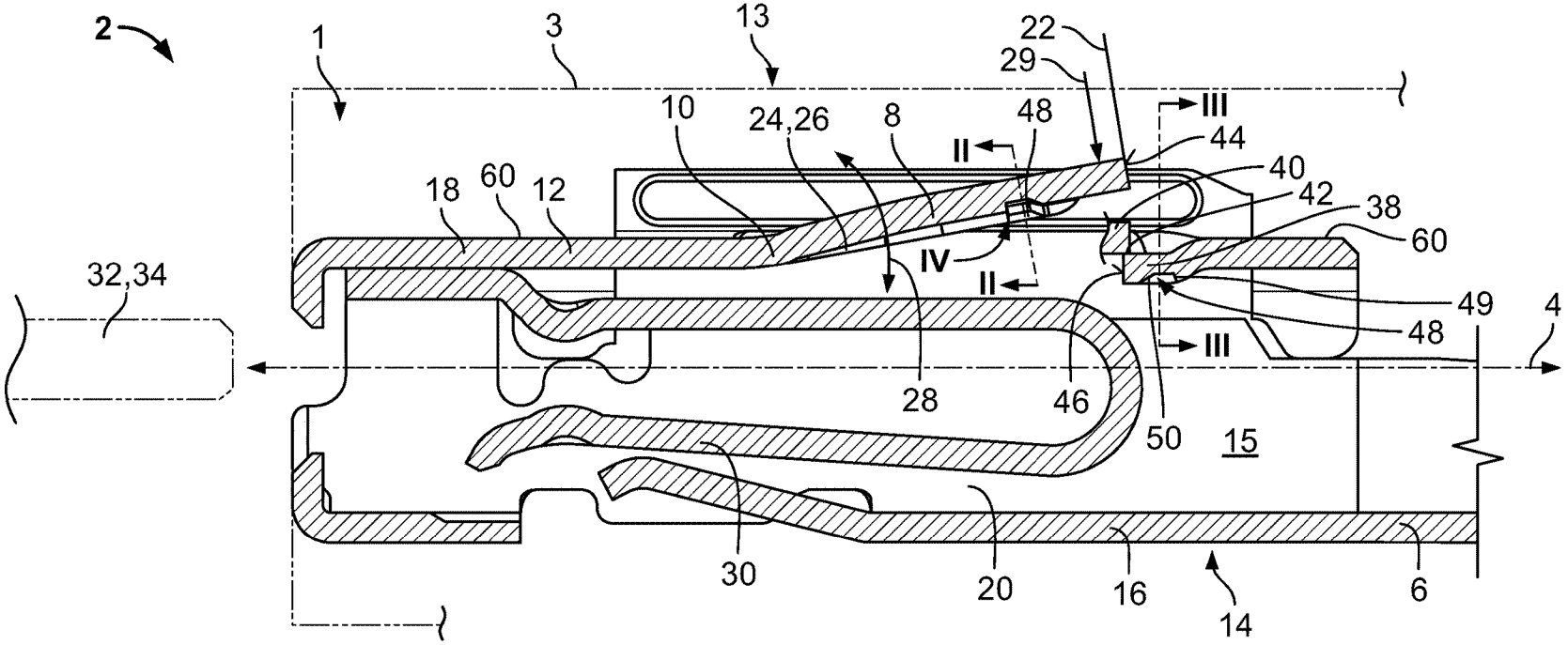
FIG. 1 is a sectional side view of a contact according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A contact 1 for an electrical connector 2 is shown in FIG. 1. In an embodiment, the contact 1 is inserted into a housing 3 of the electrical connector 2 along an insertion direction 4; the housing 3 is shown schematically in FIG. 1. The contact 1 is formed of a single piece 6 of stamped and bent sheet metal.

In order to securely fasten the contact 1 within the housing 3, as shown in FIG. 1, a latching tongue 8 is formed by the piece 6. The latching tongue 8 engages the housing 3 in a positive lock or form-fit. The latching tongue 8 is connected at a base 10 to a body 12 of the contact 1. The latching tongue 8, in its resting position 13, extends obliquely away from the body 12. The base 10 may be bent or folded.

The body 12, as shown in FIG. 1, includes a box-like or cuboid section 14 having at least one side wall 15. In the shown embodiment, the cuboid section 14 also has a lower wall 16 and an upper wall 18. The upper wall 18 extends perpendicularly with respect to the side wall 15. The base 10 connects the latching tongue 8 to the upper wall 18.

The latching tongue 8, in its unloaded resting position 13 shown in FIG. 1, protrudes away from an interior 20 of the cuboid section 14 or the contact 1. The latching tongue 8 has a free end 22 which is situated opposite the base 10. In the shown embodiment, the latching tongue 8 has at least one stiffening feature 24, such as a bead 26. The stiffening feature 24 is spaced apart from the base 10 and/or the free end 22. The stiffening feature 24 is elongated with a longer dimension of the stiffening feature 24 extending in the direction from the base 10 to the free end 22.

The latching tongue 8 is elastically deflectable around the base 10 as indicated by arrow 28 shown in FIG. 1. If the stiffening feature 24 is provided, a force 29 which deflects the latching tongue 8 about the base 10 along arrow 28 will not bend the latching tongue 8 and the base 10 acts as a hinge. Thus, the stiffening feature 24 renders the latching tongue 8 rigid along its length.

For inserting the contact 1 into the housing 3 or for removing the contact 1 from the housing 3, the latching tongue 8 must be deflected in order to release any latching engagement within the housing 3. For this, the latching tongue 8 is moved towards the body 12, and in particular, towards the cuboid section 14.

Underneath the latching tongue 8, in the interior 20, a contact spring 30 shown in FIG. 1 establishes contact with a mating contact 32, such as a contact tab 34, which is inserted into the interior 20. The location of the contact spring 30 underneath the latching tongue 8 creates the risk that the latching tongue 8 is pressed against the contact spring 30 by the force 29. If, in such a case, the contact spring 30 is deformed by the latching tongue 8, a contact force acting between the contact spring 30 and the mating contact 32 may fall outside any prescribed limits.

In order to avoid the latching tongue 8 pressing against the contact spring 30, a limit stop 38 shown in FIG. 1 is formed from the piece 6 and spaced apart from the latching tongue 8. In the shown embodiment, the limit stop 38 is spaced apart from the free end 22 of the latching tongue 8 in the resting position 13. In the fully deflected position 40 of the latching tongue 8, shown in FIG. 1, the free end 22 of the latching tongue 8 abuts the limit stop 38; the limit stop 38 has an overlap 42 with the latching tongue 8. Although the free end 22 rests on the limit stop 38 in the fully deflected position 40 of the latching tongue 8 in the shown embodiment, other portions of the latching tongue 8 may rest on the limit stop 38 in the fully deflected position 40 in addition to or instead of the free end 22 in other embodiments. For example, the limit stop 38 may interact with any section of the latching tongue 8 located between the base 10 and the free end 22 to block excessive deflection of the latching tongue 8. The limit stop 38 is positioned such that the deflection of the latching tongue 8 is limited to elastic, and not plastic, deformation.

The single piece 6 shown in FIG. 1 has been cut in order to separate the latching tongue 8 from the limit stop 38. Thus, the end faces 44, 46 of the latching tongue 8 and the limit stop 38, respectively, were once monolithically connected but have been severed from each other. In order to create the overlap 42, at least one of the latching tongue 8 and the limit stop 38 is elongated plastically. A plastic elongation may be created, for example, by providing an embossing 48 in at least one of the latching tongue 8 and the limit stop 38.

Figure 4:
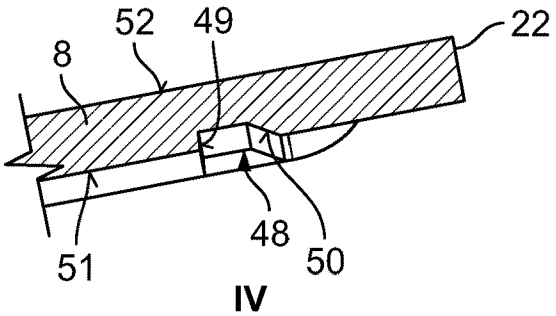
FIG. 4 is sectional side view of a portion IV of the contact of FIG. 1.

The embossing 48 is shown in greater detail in FIG. 4. In the embossing 48, a stamp (not shown) has been pressed into the material of the latching tongue 8 and/or the limit stop 38, thus displacing material plastically. The displacement of material at the embossing 48 creates an elongation of the respectively embossed latching tongue 8 and/or limit stop 38. The elongation in turn leads to the overlap 42 which would not be present without the embossing 48. In the shown embodiment, the embossing 48 has a straight side 49 which is inclined steeper, in particular perpendicular, to the embossed surface of the latching tongue 8, than an inclined, e.g. chamfered or beveled, side 50, which is inclined at a shallower angle with respect to the embossed surface. In various embodiments, the inclined side 50 may be inclined between 15° and 60° or between 30° and 50° with respect to the embossed surface. The inclined side 50 is closer to the respective end face 44, 46 of the latching tongue 8 and/or the limit stop 38 than the straight side 49. As shown in the embodiment of FIG. 4, the inclination of the inclined side 50 extends continuously to the bottom of the embossing 48.

As shown in FIG. 4, the embossing 48 is located on a first side 51 of the latching tongue 8 which faces the limit stop 38 and the interior 20. This leaves a second side 52 of the latching tongue 8 which faces away from the limit stop 38 as a smooth surface so that the latching tongue 8 may slide more easily into and out of the electrical connector 2. To achieve this, the embossing 48 does not push through to the second side 52. Except for the elongation and the optional stiffening feature 24, there is no other deformation perpendicular to the direction of the elongation of the one or both of the latching tongue 8 and/or the limit stop 38 that features the embossing 48. In another embodiment, in order to increase the elongation, more than one embossing 48 may be provided in the latching tongue 8 and/or limit stop 38.

Figure 2:
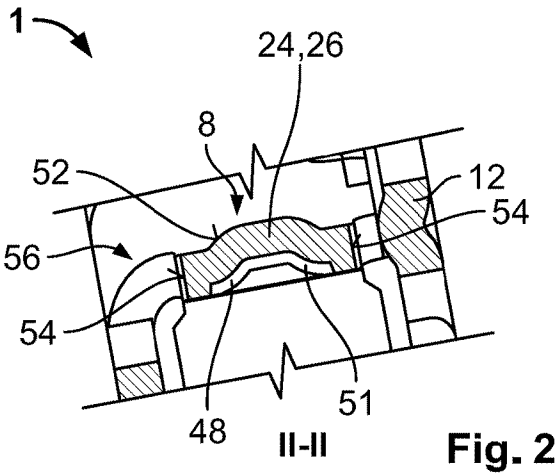
FIG. 2 is a sectional rear view of the contact taken along line II-II of FIG. 1.

A cross-sectional shape of the latching tongue 8 at the embossing 48 and the stiffening feature 24 is shown in FIG. 2. The stiffening feature 24 creates a convex shape of the latching tongue 8 on the second side 52 facing away from the limit stop 38. The first side 51 facing towards the limit stop 38 is concave. The stiffening feature 24, for example the bead 26, is spaced apart from the edges 54 which connect the sides 51 and 52 and run from the base 10 to the free end 22. The edges 54 are in turn spaced apart from the body 12 to allow free moveability of the latching tongue 8. Originally, the edges 54 were monolithically connected with the body 12 but have been severed from the body 12 in order to form the latching tongue 8. The latching tongue 8 is thus located in an opening 56 which, except for the base 10, surrounds the latching tongue 8 on at least three sides.

The embossing 48, as shown in FIG. 2, extends across the stiffening feature 24. In an embodiment, this is achieved by first creating the embossing 48 in the latching tongue 8 and then forming the stiffening feature 24. The embossing 48 is, as is the stiffening feature 24, spaced apart from the edges 54. In an embodiment, the depth of the embossing 48 is less than half a material thickness of the piece 6, and in another embodiment is between one-fifth and one-third of the material thickness. The width of the embossing 48 in the direction in which the elongation takes place may be between an entire and one-third of the material thickness, i.e. in the direction extending between the base 10 and the limit stop 38. These dimensions are independent of whether the embossing 48 is in the latching tongue 8 or the limit stop 38. The embossing 48 has an elongated shape with a longer side 58 extending perpendicular to the direction from the base 10 to the free end 22 and parallel to the base 10.

In an embodiment, the limit stop 38 may be shifted with respect to the base 10 in a direction facing away from the latching tongue 8 and towards the interior 20 of the cuboid section 14. The displacement of the limit stop 38 towards the interior 20 allows a further deflection of the latching tongue 8 towards the body 12 and thus a better alignment of the latching tongue 8 with the body 12, in particular an alignment with a substantially planar section 60 of the body 12 shown in FIG. 1 or the upper wall 18. The planar section 60 is located on the side of the base 10 opposite the latching tongue 8 and/or beyond the limit stop 38. Such a flush alignment of the latching tongue 8 with the body 12 allows a reduction in the size of the opening needed in the electrical connector 2 for insertion of the contact 1.

Figure 3:
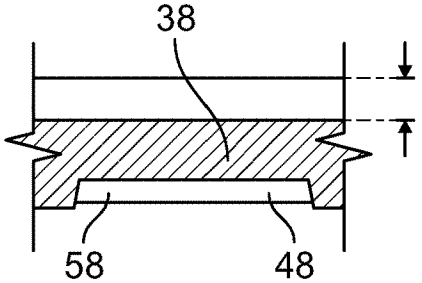
FIG. 3 is a sectional front view of the contact taken along line III-III of FIG. 1.

The embossing 48 of the limit stop 38 is shown in FIG. 3. The embossing 48 in the limit stop 38 may be an elongated impression of substantially cuboid shape, the longer side 58 of the embossing 48 being oriented parallel to the free end 22 or the base 10. The embossing 48 of the limit stop 38 may be substantially of the same shape as shown in FIG. 4 except that the embossing 48 of the latching tongue 8 is deformed when the stiffening feature 24 is generated.

Figure 6:
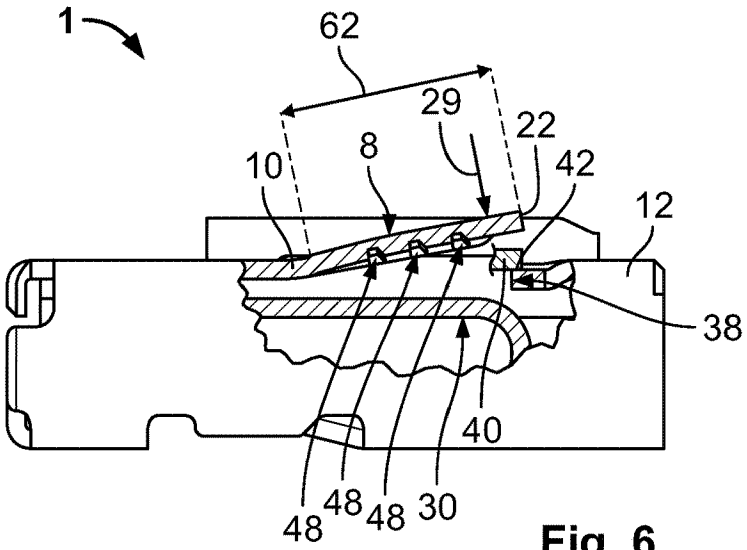
FIG. 6 is a side view of a contact according to another embodiment.
Figure 5:
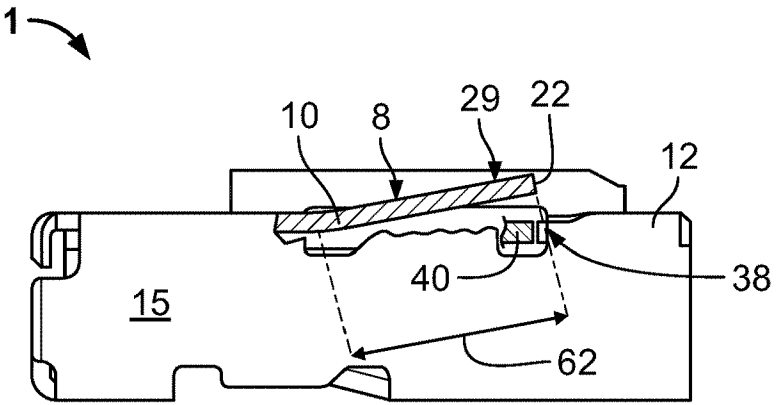
FIG. 5 is a side view of a contact without a plastically elongated latching tongue or limit stop.

The effect of the embossings 48 is described in greater detail with reference to FIGS. 5 and 6. In an embodiment of a contact 1 shown in FIG. 5, the latching tongue 8 does not have embossings 48. The latching tongue 8 has been cut from the limit stop 38 so that there is no overlap 42 in the deflected position 40. If the latching tongue 8 is deflected towards the body 12 by the force 29, it will therefore pass the limit stop 38. By comparison, in the contact 1 shown in FIG. 6, three embossings 48 have been imprinted into the latching tongue 8. As a result of the embossings 48, the length 62 of the latching tongue 8 from the base 10 to the free end 22 is increased in comparison to FIG. 5. The increase results in the overlap 42 between the free end 22 and the limit stop 38. Due to the overlap 42, the latching tongue 8 can no longer pass the limit stop 38 but is supported by the limit stop 38 if deflected towards the body 12 under force 29. In other embodiments, the latching tongue 8 or limit stop 38 may have more than three or less than three embossings 48.

Steps for manufacturing the contact 1 will now be described in greater detail with reference to FIGS. 7A-9B.

As shown in FIGS. 7A and 7B, the piece 6 is a planar, stamped blank made from sheet material. In the state shown in FIGS. 7A and 7B, the latching tongue 8 has just been separated from the limit stop 38 at separation line 64. The two end faces 44, 46 are formed by the separation. Further, the opening 56, which includes the separation line 64, is shown in FIG. 7A. The latching tongue 8 protrudes into the opening 56 towards the limit stop 38. The limit stop 38 may also protrude into the opening 56 towards the latching tongue 8.

In FIGS. 7A and 7B, the piece 6 has not yet been bent; the result of a bending process is shown in FIGS. 8A and 8B. The tongue 8 is plastically deflected out of the plane 66 of the blank piece 6. The acute angle 68 between what will become the body 12 of the contact 1, in particular its upper wall 18, and the latching tongue 8 may be between 2° and 10°, between 3° and 8°, or about 5°. The plastic deformation which leads to the inclination of the latching tongue 8 with respect of the plane 66 of the blank is concentrated in the base 10. Between the base 10 and the free end 22, the latching tongue 8 stays straight.

In the next step of the process of manufacturing the contact 1, shown in FIGS. 9A and 9B, the embossings 48 are first imprinted into the latching tongue 8. Then, the stiffening feature 24, such as the bead 26, is formed into the embossed latching tongue 8. Of course, it is also possible to first form the stiffening feature 24 into the latching tongue 8 and then elongate the latching tongue 8 by the embossings 48. The latter approach, however, requires a more complex shape of the punches forming the embossings 48, as the shape of the stiffening feature 24 has to be considered. In another embodiment, the latching tongue 8 may be bent out of the plane 66 only after the at least one embossing 48 and/or the stiffening feature 24 has been formed. The limit stop 38 is shifted out of the plane 66 in the direction facing away from the latching tongue 8. The amount 70 by which the limit stop 38 is shifted is between one-quarter and an entire material thickness 72 of the body 12.

Figure 10:
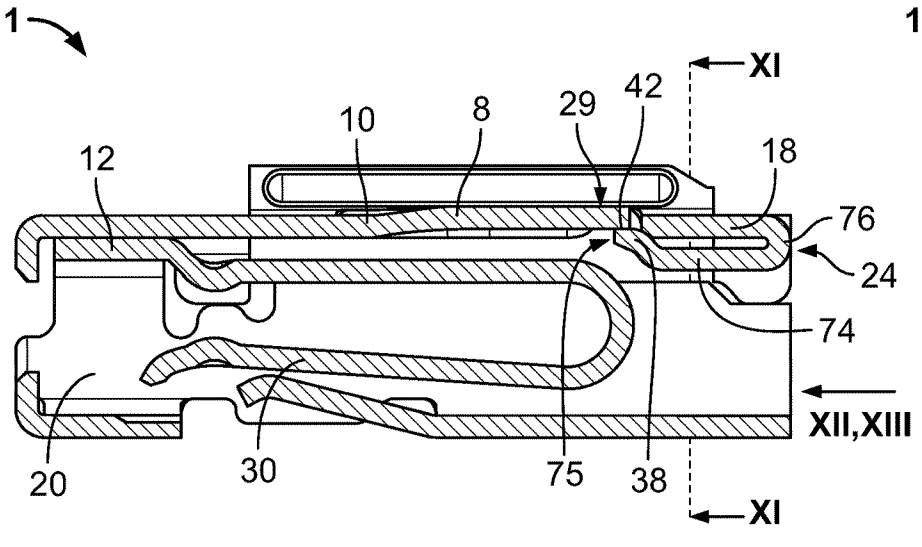
FIG. 10 is a sectional side view of a contact according to another embodiment.

As shown in FIG. 10, in another embodiment, the limit stop 38 may be formed by a flap 74 which protrudes towards the base 10 underneath the latching tongue 8, between the latching tongue 8 and the interior 20 of the contact 1 and/or between the latching tongue 8 and a contact spring 30. The flap 74 extends underneath the upper wall 18 on the side of the upper wall 18 which faces away from the latching tongue 8 in the resting position 13, in particular parallel to the upper wall 18. Such a flap 74 may be provided instead or in addition to elongating at least one of the limit stop 38 and the latching tongue 8. The flap 74 may be bent or folded back onto itself, for example as a zero or one T bend, being bent or folded by 180°. The overlap 42 is formed by a free end 75 of the flap 74. The flap 74 may be provided with stiffening features 24 in particular in weakened areas, such as a bend or fold 76. Such a stiffening feature 24 avoids deflection of the limit stop 38 if the force 29 is high.

In an embodiment, a support 80 is formed underneath the limit stop 38 as shown in FIGS. 11-14. The limit stop 38 is thus arranged between the latching tongue 8 and the support 80. The support 80 may be formed from the body 12 by bending or folding from the side wall 15. The support 80 may be used together with a limit stop 38 as described with respect to FIGS. 1-9B.

Figure 11:
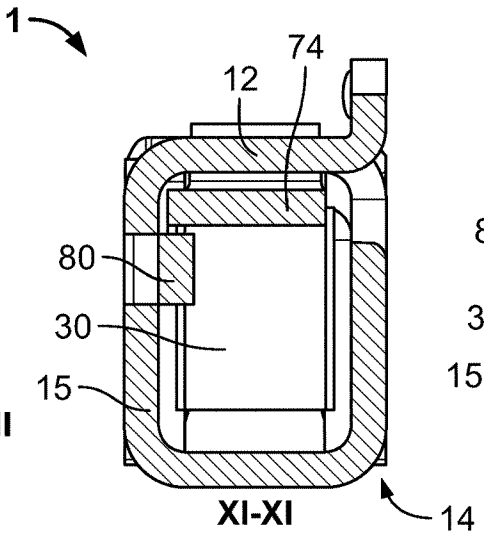
FIG. 11 is a sectional front view of a contact according to another embodiment taken along line XI-XI of FIG. 10.

In the embodiment shown in FIG. 11, the support 80 is formed by a deep drawing process and the side wall 15 is simply bent underneath the limit stop 38. The support 80 may be separated from the side wall 15 in the direction facing towards the limit stop 38 and facing away from the limit stop 38.

Figure 12:
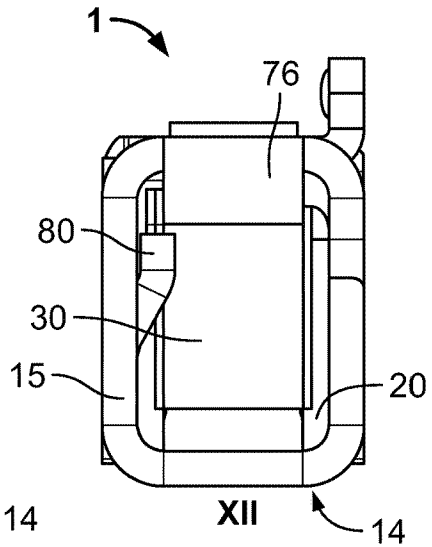
FIG. 12 is a front view of a contact according to another embodiment taken along arrow XII of FIG. 10.
Figure 13:
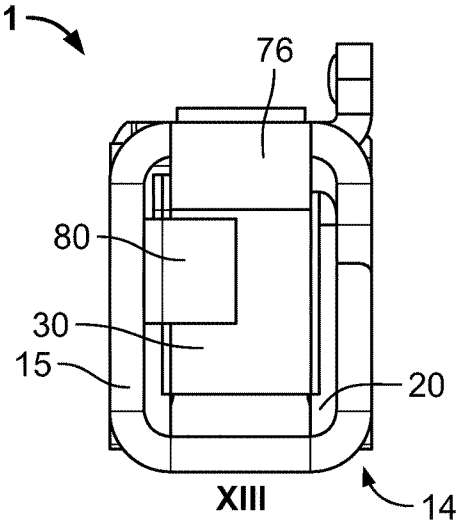
FIG. 13 is a front view of a contact according to another embodiment taken along arrow XIII of FIG. 10.

Alternatively, as shown in FIGS. 12 and 13, the support 80 may be formed by a shearing process just like the tongue 8. In this case, the support 80 is separated from the side wall 15 at at least three sides and bent underneath the limit stop 38. The free end of the support 80 may face towards the limit stop 38, as shown in FIG. 12, or a side running perpendicular to the free end of the support 80 may face the limit stop 38, as shown in FIG. 13.

Figure 14:
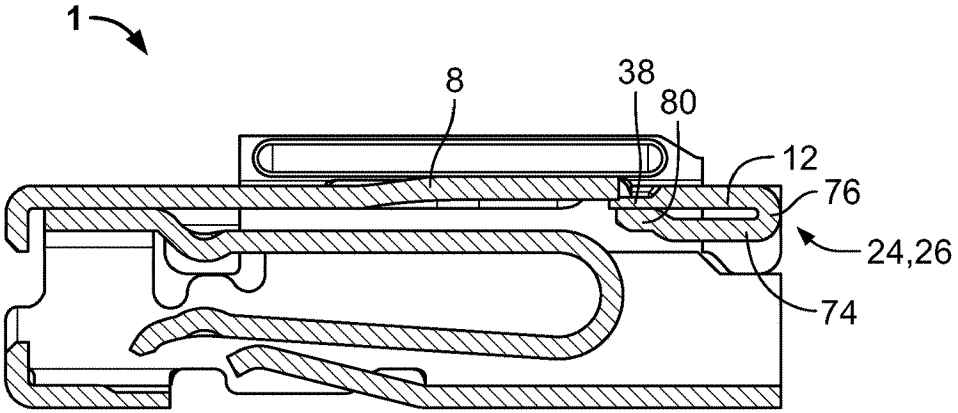
FIG. 14 is a sectional side view of a contact according to another embodiment.

The support 80, as shown in FIG. 14, may also be formed by a flap 74 which is bent back onto itself or connected by a 180° bend or fold 76 to the body 12 underneath the limit stop 38 on the side of the limit stop 38 facing away from the latching tongue 8. For stiffening the flap 74, a stiffening feature 24 such as a bead 26 may be provided in the flap 74 and/or the bend or fold 76.

What is claimed is:

1. A contact for an electrical connector formed of a single piece of stamped and bent sheet metal, the contact comprising:

a body having a base;

a limit stop; and a latching tongue connected to the body at the base and having a free end opposite the base, at least one of the latching tongue and the limit stop includes an embossing elongating the at least one of the latching tongue and the limit stop, the latching tongue is spaced apart from the limit stop in a resting position of the latching tongue and the latching tongue abuts the limit stop in a deflected position of the latching tongue.

2. The contact of claim 1, wherein the latching tongue includes the embossing elongating the latching tongue in a direction away from the base to form an overlap at which the latching tongue abuts the limit stop.

3. The contact of claim 1, wherein the limit stop includes the embossing elongating the limit stop in a direction toward the base to form an overlap at which the latching tongue abuts the limit stop.

4. The contact of claim 2, wherein the latching tongue includes a plurality of embossings.

5. The contact of claim 2, wherein the embossing is elongated in a direction parallel to the base.

6. The contact of claim 2, wherein the embossing has a straight side and an inclined side, the inclined side having a smaller inclination than the straight side with respect to an embossed surface of the latching tongue in which the embossing is disposed.

7. The contact of claim 1, wherein the latching tongue has a stiffening feature.

8. The contact of claim 1, wherein the limit stop protrudes from the body toward the base.

9. The contact of claim 1, wherein, in the deflected position of the latching tongue, the free end of the latching tongue abuts the limit stop.

10. The contact of claim 1, wherein the limit stop is formed by a bent flap.

11. The contact of claim 1, further comprising a support bent underneath the limit stop.

12. The contact of claim 11, wherein the limit stop is disposed between the support and the latching tongue in the deflected position of the latching tongue.

13. The contact of claim 1, wherein the limit stop is shifted with respect to the body in a direction facing away from the latching tongue.

14. The contact of claim 1, wherein the body has a cuboid section and the latching tongue is arranged in the cuboid section.

15. The contact of claim 14, wherein the latching tongue extends obliquely away from an interior of the cuboid section and the limit stop is arranged between the latching tongue and the interior.

16. A method for manufacturing a contact from sheet metal, comprising:

forming a latching tongue from a single piece of the sheet metal, the latching tongue remaining attached to a body of the single piece of the sheet metal by a base;

forming a limit stop for the latching tongue from the single piece of the sheet metal, the limit stop overlapping the latching tongue; and embossing at least one of the latching tongue and the limit stop to elongate the at least one of the latching tongue and the limit stop.

17. The method of claim 16, wherein the step of forming the latching tongue includes severing the latching tongue from the limit stop.

* * * * *